US007027078B2

(12) United States Patent
Reihl

(10) Patent No.: US 7,027,078 B2
(45) Date of Patent: Apr. 11, 2006

(54) METHOD, CONTROL CIRCUIT, COMPUTER PROGRAM PRODUCT AND PRINTING DEVICE FOR AN ELECTROPHOTOGRAPHIC PROCESS WITH TEMPERATURE-COMPENSATED DISCHARGE DEPTH REGULATION

(75) Inventor: Heiner Reihl, Freising (DE)

(73) Assignee: Oce Printing Systems GmbH, Poing (DE)

( * ) Notice: Subject to any disclaimer, the term of this patent is extended or adjusted under 35 U.S.C. 154(b) by 207 days.

(21) Appl. No.: 10/698,325

(22) Filed: Oct. 31, 2003

(65) Prior Publication Data

US 2005/0063719 A1 Mar. 24, 2005

(30) Foreign Application Priority Data

Oct. 31, 2002 (DE) ..... 102 50 827

(51) Int. Cl.
*B41J 2/435* (2006.01)

(52) U.S. Cl. ..... 347/236; 347/246

(58) Field of Classification Search ..... 347/236–237, 347/246–247, 132–133, 140; 399/44, 47–51, 399/94–96, 127–128
See application file for complete search history.

(56) References Cited

U.S. PATENT DOCUMENTS

| | | | | |
|---|---|---|---|---|
| 5,124,732 | A | 6/1992 | Manzer et al. | 347/140 |
| 5,937,259 | A | 8/1999 | Kopp et al. | 399/384 |
| 6,097,419 | A | 8/2000 | Morris et al. | 347/237 |
| 6,370,351 | B1 | 4/2002 | Puritscher et al. | 399/313 |

FOREIGN PATENT DOCUMENTS

| | | |
|---|---|---|
| DE | 35 34 338 | 4/1987 |
| EP | 0 210 077 | 1/1987 |
| EP | 0 403 523 | 11/1992 |
| JP | 03289681 | 12/1991 |
| JP | 05107888 | 4/1993 |
| WO | WO 89/08283 | 9/1989 |
| WO | WO 96/37862 | 11/1996 |
| WO | WO 97/17635 | 5/1997 |
| WO | WO 99/24875 | 5/1999 |
| WO | WO 00/41038 | 7/2000 |

OTHER PUBLICATIONS

Das Druckerbuch—Gerd Goldmann, May 2001.

*Primary Examiner*—Hai Pham
(74) *Attorney, Agent, or Firm*—Schiff Hardin LLP

(57) ABSTRACT

With a control device to optimize charge image generation in an electrophotographic process, a light-sensitive and temperature-sensitive photoconductor layer is exposed pixel-by-pixel with a temperature-sensitive light source. The photoconductor layer becomes more sensitive with rising temperature, such that given a predetermined light quantity it discharges deeper. With rising temperature, given the same actuating power, the light source emits a lesser luminous power. The luminous power of the light source and the discharge depth of the photoconductor layer are temperature-dependent via adjustment of the current and/or the luminous duration that flows through the light source and/or the luminous duration. During the measurement of the discharge depth, a temperature measured in the course of the measurement event is used as a reference value for the temperature compensation of the light source.

8 Claims, 4 Drawing Sheets

METHOD, CONTROL CIRCUIT, COMPUTER PROGRAM PRODUCT AND PRINTING DEVICE FOR AN ELECTROPHOTOGRAPHIC PROCESS WITH TEMPERATURE-COMPENSATED DISCHARGE DEPTH REGULATION

BACKGROUND OF THE INVENTION

The invention concerns printing devices. It concerns in particular a method, a control circuit, a computer program product and a printing device for an electrophotographic process with temperature-compensated discharge depth regulation.

An electrophotographic printing device is, for example, known from WO 00/41038. Information is thereby transmitted via a plurality of light sources (LED comb) or a luminosity-modulated laser beam onto a photoelectric layer (photoconductor), and therewith generates a charge image on the photoconductor. The latent charge image then passes through a developer station in which regions of different charge of the photoconductor are inked differently with toner. To stabilize such a developer process in spite of different operating conditions of the printing system, in particular temperature fluctuations of diverse components important to the electrophotographic process, it is important to bring to as uniform a value as possible the potential height of the locations of the photoconductor discharged via light. For this, the potential difference between the discharge depth of the exposed image locations and the potential level of the developer step is significant. While the potential level of the developer step can be regulated in a purely electrical manner, the influence factors for the potential difference are complex; in particular the luminous power of the light-generating device (character generator) with its influencing variables and the sensitivity of the photoconductor thereby play important roles. With the increasing process speed of electrophotographic printers, under otherwise identical boundary conditions the necessity increases to operate the light sources with increased energy, because the residence time is less due to the increased process speed and because the temporal separations of the sequential subprocesses between exposure and development of a latent charge image are reduced. The discharge via light does not occur abruptly in the region of the interaction, but rather approximately exponentially over time, conditional upon charge transport effects. A possibility to increase the available luminous power is to displace the working point for the emitted luminous power of the light source. Given LED combs as light sources, this means that the compensation for the uniformity of the light emission over the width of the comb must either be implemented in a shortened luminous duration (given the same light energy) or, however, implemented given an increased driver current of the light-emitting diodes. The possibility to use increased driver current is, however, only conditionally possible, since light-emitting diodes have a characteristic dependency of the luminous intensity on the temperature of the diode. Therefore a temperature compensation is necessary and the temperature compensation of the light yield requires a known additional upper margin. Furthermore, a current increase also affects the stability of the light-emitting diode over the lifespan, and thus the lifespan itself.

It is known from "Das Druckerbuch, Technik und Technologien der Drucksysteme", Dr. Gerd Goldmann (Hsg.), Océ Printing system GmbH, 6th edition (May 2001), ISBN 3-00-001019-X, Chapter 2.2.4, page 5–22 to compensate the light strength of character generator light-emitting diodes via the luminous duration of the individual diodes. An individual luminous strength is therewith ensured over the width of the comb. The luminous duration times can be defined as a multiple of the periods of a set compensation frequency; a scaling of this frequency thereby leads to a scaling of the luminous duration, whereby the uniformity of the compensation can be (exactly) maintained. The variable (what is known as a) time base clock frequency exhibits two extreme values that, on the one hand, are defined upwards via the hardware-technical properties of the conductions on the character generator comb (conduction reflections) and, on the other hand are defined downwards by the necessity to be able to accommodate within a micro-row the correspondingly scaled, complete time scale from the compensation, meaning for example 255 periods of the time base clock (TBC). Since the time for the writing of a micro-row is dependent on speed, a speed-dependent lower boundary frequency thus also occurs.

A printing device with a photosensitive body is known from JP-A-03-289 681, in which the light quantity with which the photosensitive body is exposed is controlled. The control occurs dependent on a test exposure in which the actual surface potential of the photosensitive layer is determined, such that its changes are compensated based on temperature variations or changes of humidity.

A laser printing device with a light-sensitive body is known from EP-A2-210 077 in which the sensitivity of the light-sensitive body has a positive temperature characteristic.

A printing device with a photoconductor is known from JP-A-05-107 888 in which the surrounding temperature of the photoconductor is measured and is adjusted dependent on the measured temperature of the exposure strength.

It is known from DE-A1-35 343 38 that light-emitting diodes have a temperature response, and that this is compensated in an electrophotographic printer in which the diode trigger signals are varied depending on the temperature of the diodes.

SUMMARY OF THE INVENTION

It is an object of a first aspect of the invention to stabilize a development process on a latent charge image, such that in spite of different operating conditions of the printing system, in particular given different temperatures of diverse components important to the electrophotographic process, a good inking as constant as possible is to be achieved.

The invention further concerns a second aspect that is connected with the exposure and development of a latent charge image on an electrophotographic medium. Especially in cold printers that have not yet achieved the operating temperature, an insensitive photoconductor drum and a fast process speed are not sufficient for the initial luminous power of a character generator to achieve the necessary discharge depth for regions of the printing image to be exposed. Depending on conditions and height of the variation, this can lead to the quality of the printed documents falling below a certain minimum quality criterion. Only after the photoconductor sensitivity is raised via the heating of the entire device in the printing operation is the necessary discharge depth achieved. According to the second aspect of the invention, it is an object to ensure a high printing quality if at all possible at the first printed page.

According to the control device and method of the invention for optimizing load image generation in an electrophotographic process, a light-sensitive and temperature-sensitive photoconductor layer is exposed pixel-by-pixel with a temperature-sensitive light source, the photoconductor layer becoming more sensitive with rising temperature, such that given a predetermined quantity of light and predetermined charge it discharges deeper, and the light source emits a lesser luminous power with rising temperature given a same actuation power. Temperature compensation is respectively provided for the light source and for the photoconductor layer, whereby the temperature compensation occurs for the photoconductor layer via at least one of adaptation of current flowing through the light source and adaptation of exposure time of the light source. The temperature compensation of the light source is provided via at least one of connection of the current flowing through the light source and via the change of the exposure time, whereby for temperature compensation of the photoconductor layer a measurement event occurs in which the discharge depth of the photoconductor layer occurs given predetermined luminous duration and predetermined current through the light source. A temperature of the light source measured in the course of the measurement event is used as a reference value for the temperature compensation of the light source.

DESCRIPTION OF THE PREFERRED EMBODIMENTS

Figure 1:
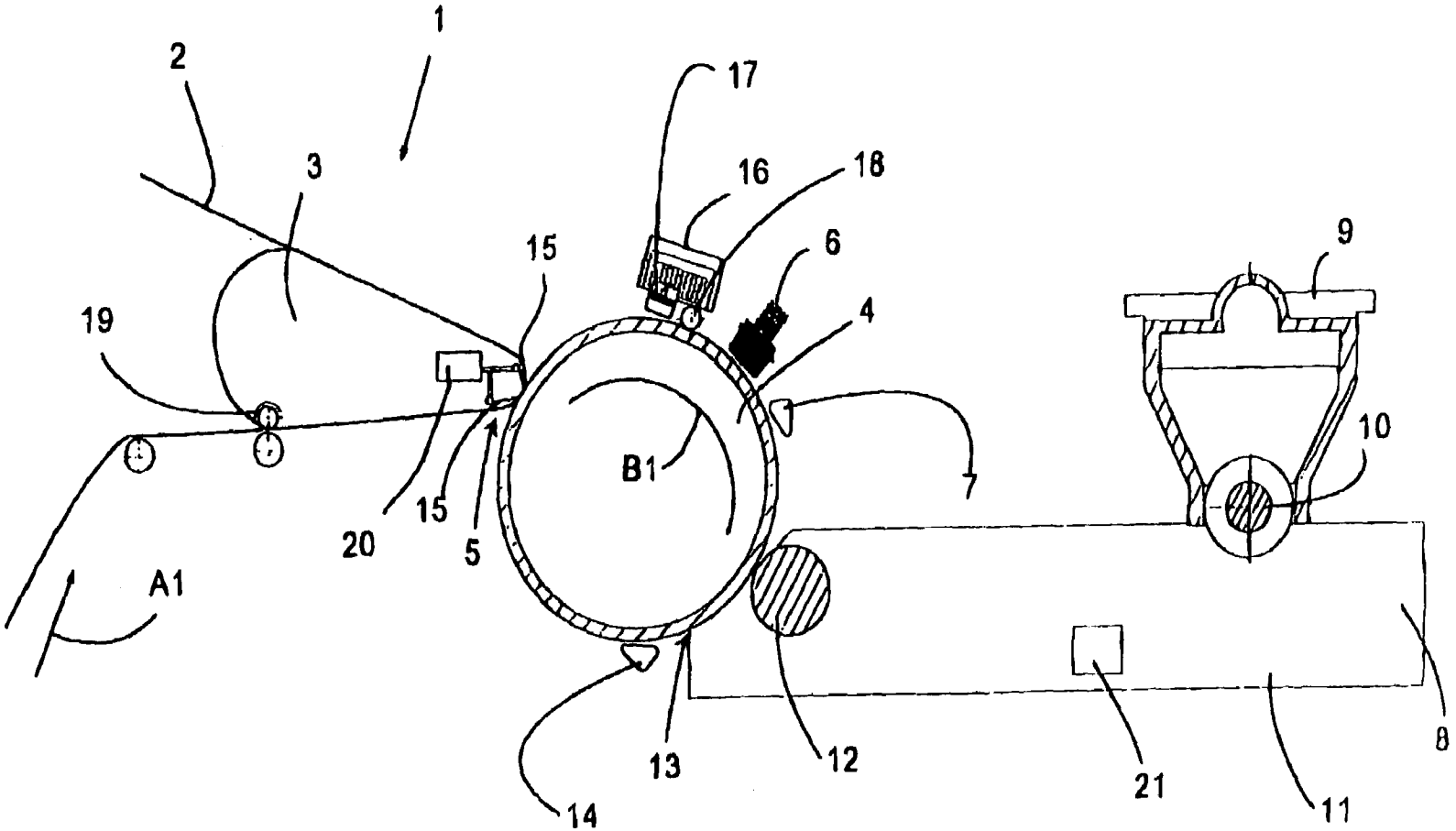
FIG. 1 is an electrophotographic printing device.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

According to a first aspect, to optimize the charge image generation in an electrophotographic process, whereby a light-sensitive and temperature-sensitive photoconductor layer is exposed pixel-by-pixel with a temperature-sensitive light source, the photoconductor layer becomes more sensitive with rising temperature. Thus it discharges deeper given predetermined light quantities, and the light source emits a lesser luminous power with rising temperature, given the same drive power. A temperature compensation thereby respectively occurs for the light source and the photoconductor layer, whereby the temperature compensation for the photoconductor layer occurs via adaptation of the current flowing through the light source and/or the exposure time of the light source, and whereby the temperature compensation of the light source occurs via connecting the current flowing through the light source and/or via the variation of the exposure time. Furthermore, a measurement event occurs for temperature compensation of the photoconductor layer, in which the discharge depth of the photoconductor layer occurs via the light source given predetermined light duration and predetermined current, whereby a temperature of the light source measured in the course of the measurement event is used as a reference value for the temperature compensation of the light source.

The luminous power of solid-state light sources such as LED character generators or semiconductor lasers is a function of the current, of the temperature of individual light sources (LEDs or, respectively, laser) or the total aggregate, in the case that the light source forms a thermal unit with a massive solid-body such as, for example a heat sink.

With the preferred embodiment, an independent temperature control via a temperature measurement compensates the luminous power via the variation of the current flowing through the light source. Thus, with rising temperature, a higher current value must be used for the same luminous power, and the temperature compensation for the photoconductor layer occurs via the exposure time of the light source.

Furthermore, with the preferred embodiment, a general temperature increase in the printing device leads to opposite effects: while an increase of the photoconductor temperature leads to a higher light sensitivity of the photoconductor, and thus requires a reduction of the light intensity via lower current or shorter luminous duration, at the same time the light intensity of the LEDs becomes less, for which the LED current must be increased in order to stabilize the light intensity for increasing temperature. In the case of the same regulation type or control type (for example, energetic or temporal), this leads, due to the opposite standard characteristic, to a reduction of the standard bandwidth in both branches, since the respectively different regulation "uses" a part of the predetermined margin for its own purposes.

A temperature of the light source measured in the course of the measurement event is used as a reference value for the temperature compensation of the light source during the discharge depth measurement of the photoconductor layer, the opposite effects of both regulations is counteracted, and thus the standard bandwidth of both branches is increased. A limiting with regard to the standard bandwidth is thereby preventable. Via the combined regulation of both branches, whereby the current temperature value of the character generator is used as a reference value (for the temperature compensation of the character generator), only the net effect of decreasing light yield in the light source and rising photosensitivity for the discharge depth is still compensated. Due to the opposed function of both effects, the total control range is thus increased, and simultaneously the variation of the current through the light source (for example LED), and thus the amount of possible variations of the light yield among themselves, is clearly reduced via the compensation value.

With regard to the conventional method to stabilize electrophotographic processes, in the first aspect of the preferred embodiment it is in particular provided that the previously separated stabilization of the temperature-dependent light energy on the one hand and the discharge depth regulation of influences on the photoconductor via an independent luminous power control on the other hand is merged into a common concept for luminous power regulation.

According to a preferred exemplary embodiment, the light energy of the light source is maintained at a constant level between successive discharge depth measurements. The temperature-dependent regulation of the light source thereby occurs in particular via the current flowing through the light source. Furthermore, a correction therm is thereby in particular introduced as a function of the variation of the reference temperature that effects a predetermined light energy change and deactivates the correction therm while the measurement of the discharge depth occurs. Via adaptation of the reference temperature of the character generator to the current temperature during the discharge depth measurement, an accumulating effect can be prevented in the temperature control of the light source, which also leads to an increased adjustment range of the luminous power because only the net effect must still be compensated. Consequently, the printing system can ensure the maintenance of the discharge depth over a larger climatic range, and thus the quality of the printing process with regard to inking, uniformity of the line thicknesses, dot gain, and contrast levels can be maintained at a high level.

In a preferred exemplary embodiment, according to a first aspect, during the adjustment of the luminous duration, dependent on the discharge depth, a temperature of the light source measured in the course of the discharge depth measurement event is used as a reference temperature for the temperature-dependent current regulation. The light source temperature can thereby be determined in temporal proximity to the discharge depth measurement event, meaning temporally shortly before the discharge depth measurement event or during the discharge depth measurement event.

In an alternative advantageous exemplary embodiment, during the adjustment of the current dependent on the temperature of the light source, a temperature of the photoconductor layer measured in the course of the light source temperature measurement event is used for the discharge depth-dependent luminous duration regulation. The temperature of the photoconductor layer can thereby be measured temporally close before the light source temperature measurement event, or at the beginning of the light source temperature measurement event. In a further advantageous exemplary embodiment, for discharge depth regulation the discharge depth is measured cyclically, permanently, or as needed, and given variation of a desired quantity the light source is readjusted via the change of the radiated light energy. Furthermore, it can be advantageous that the light energy of the light source is constantly maintained between successive discharge depth measurements.

According to a second aspect that can also be viewed as independent from the first aspect, and that in particular is suitable to achieve the second object cited above, in an operating phase of lesser temperature than a nominal temperature, a temperature overcompensation is implemented for the light source, such that the actuation power is dynamically raised superproportionally. Such an actuation is in particular encountered in the operating state of the cold start or after longer printing pauses. Given the discharge depth cold start, the luminous power of the light source is dynamically raised via a temperature over-compensation to a value corresponding to a fixed temperature value, until this temperature is achieved. This means that the overcompensation is cancelled with increasing temperature, and is ultimately discharged in the normal compensation operation. If this boundary temperature is again under-run, the amplified overcompensation occurring again with increasing difference.

The compensation of temperature fluctuations, and thus power fluctuations, can in particular occur between discharge depth measurements. Such discharge depth measurements can selectively occur if needed given temperature fluctuations of the light source in a more or less even range of, for example, ±3° C.

A printing device for band-shaped recording media, operating according to the principle of electrophotography, is schematically shown in FIG. 1. The band-shaped recording medium, in the form of a paper web 2, is thereby supplied with a friction roller 19 driven by motors from a drive assembly 3 in the direction $A_1$ to a photoconductor drum 4. Properties of the drive assembly 3 and further components are to be learned from WO-A-99/24875, the content of corresponding U.S. Pat. No. 6,370,351 being incorporated herein by reference. The assembly additionally comprises moving pivot elements 15 with which the paper web 2 can be pressed against the surface of the photoconductor or lifted off of it. For this, they are automatically movable with an electric actuator, for example a step motor or solenoid. Properties of suitable pivot elements are known in the form of transfer printing rockers, for example from WO 97/17635. They can in particular be designed as the rockers 40 and 44 shown in FIG. 5 of the WO publication, and be pivoted on axes such that the paper web can be swiveled back and forth, neutral with regard to length, with respect to parts of the drive aggregate lying further removed. WO 97/17635 corresponds to U.S. Pat. No. 5,937,259 incorporated herein by reference.

Coming back to FIG. 1, the paper web 2 is printed in a transfer printing zone 5. For this, it is charged over an actuated photoconductor drum 4 via various coupled assemblies with an intermediate toner image which is transfer printed to the paper web 2 in the transfer printing zone 5. A first assembly is a character generator 6 that comprises a light-emitting diode comb with individually triggerable luminous elements, and which, for example, can be designed corresponding to WO-A-96/37862, corresponding to U.S. Pat. No. 6,097,419 incorporated herein by reference. The character generator 6 can be regulated with regard to its light intensity via variation of the trigger voltage or the trigger current. An electronic control activates the individual light-emitting diodes corresponding to the image information to be printed over the luminous duration. A load sensor 7 is connected to the exposure station 13 that measures the surface potential on the photoconductor drum 4 and emits a signal dependent on this. The sign-dependent image (charge image) generated on the photoconductor drum 4 with the character generator 6 is inked with the aid of a developer station 8. The developer station 8 comprises a toner reservoir 9 to accept toner as well as a metering device 10 in the form of a metering roller. Dependent on the toner requirement, the metering roller 10 supplies toner to a mixing chamber 11. A toner/developer mixture made of ferromagnetic carrier particles and toner particles is located in the mixer chamber 11. The toner mixture is supplied to a developer roller 12. The developer roller 12 acts as what is known as a brush roller and is comprised of a hollow roller with magnetic strips arranged within. The developer roller 12 transports the developer mixture to a developing gap 13 between the photoconductor drum 4 and the developer roller 12. Excess developer mixture is transported back via the developer roller 12 to the mixing chamber 11. With regard to the rotation direction $b_1$ of the photoconductor drum 4, a toner marking sensor 14 is wired in subsequent to the developer station 11. The toner marking sensor 14 is an optoelectric scanner that, for example, can be designed as a reflection light barrier photo sensors. It is comprised of a light source and a phototransistor as a receiver. Depending on the degree of reflection, the output signal of the phototransistor is applied to the photoconductor drum 4 and information inked via the developer station. In particular, a toner mark is scanned with the sensor that serves to determine the ink saturation, meaning the applied optical density of the toner mark. The wavelength of the reflection light barrier is chosen such that the scanning light has no influence on the function of the photoconductor drum 4.

Located behind the transfer printing zone 5 viewed in the rotation direction of the photoconductor drum 4 is a cleaning device 16 with which the residue toner that in the region of the transfer printing zone 5 was not lifted from the photoconductor drum 4 or transfer printed to the paper 2 is removed from the photoconductor drum 4. The cleaning station 16 is assembled in a typical manner and comprises, for example, a stripping element 17 that strips off the excess toner or the carrier particles from the photoconductor drum 4. The cleaning process is aided by a corona device 18. Further corona devices are typically provided in the printing device in a known manner. Included for this, for example, is a load corotron that is provided between the cleaning device 16 and the character generator 6. Exposure devices that serve to discharge the photoconductor drum 4 can also be arranged in the device. Further properties of the electrophotographic process and the devices belonging to it are, for example, specified in EP 403 523 B1, the corresponding U.S. Pat. No. 5,124,732 being incorporated herein by reference.

Figure 2:
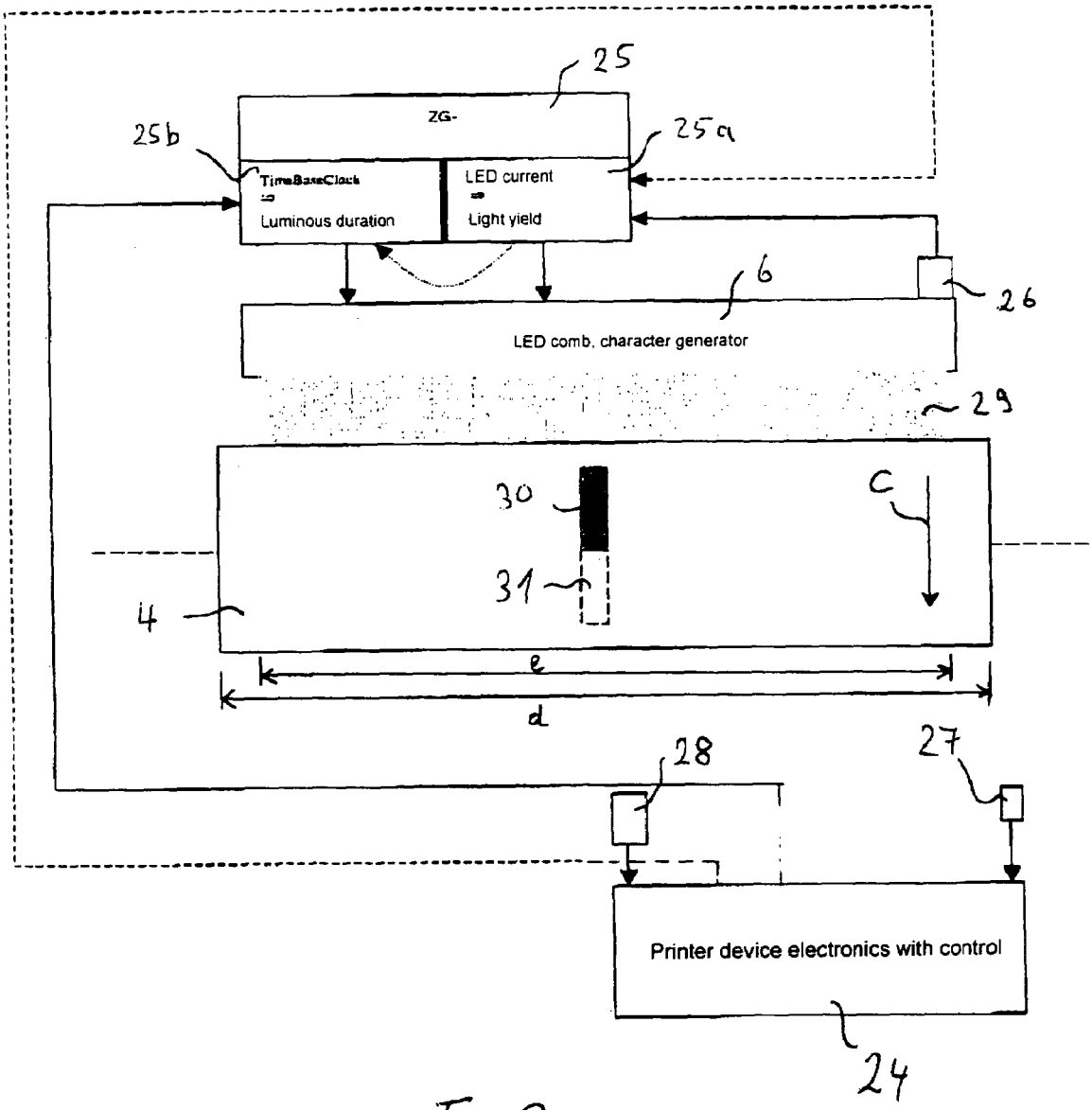
FIG. 2 shows the schema of a regulation method.

An electrophotographic printing system is schematically shown in FIG. 2 in which the printing width 1, which corresponds to the width of the exposure light 29 radiated by the LED character generator 6, is approximately the width d of the photoconductor drum 4. Discharge marks 30 to measure the discharge depth can be cyclically written and evaluated in corresponding printing breaks, while the compensation of the character generator temperature is continually possible. For discharge depth measurement, the photoconductor drum 4 is charged and then discharged with a predetermined light quantity in a region of the discharge mark 30. The discharge depth of the system results from the different measurement results between the unexposed charging zone 31 and the exposed discharge mark 30. When the photoconductor drum rotates along the process direction C, first the charge zone 31 is measured with the potential sensor, and then the discharge mark 30. Not only the discharge depth 28, but rather also the temperature of the photoconductor drum is measured by means of temperature sensor 27, and the temperature of the character generator 6 is measured by means of temperature sensor 26. Since both the light-sensitive layer of the photoconductor drum 4 and the light-emitting diodes of the character generator 6 are temperature-sensitive, the respective temperatures are respectively measured with temperature sensors 26, 27. The photoconductor layer thereby has the property that with rising temperature it becomes more sensitive, such that given a predetermined light quantity it discharges deeper. The light-emitting diodes of the character generator 6 have the property that with rising temperature given the same activating power, they emit a lesser luminous power. In order to achieve a combined temperature-discharge depth regulation, the luminous power emission of the character generator and the discharge depth of the photoconductor drum 4 are regulated dependent on temperature via adjustment of the luminous duration of the light-emitting diodes, such that during the measurement of the one quantity as a temperature reference value, a temperature measured in the course of the measurement event is used as the other quantity. This means, for example, that, in the calibration of the discharge depth of the photoconductor drum, the current temperature of the LED comb of the character generator 6 is measured with the temperature sensor 26, and the desired temperature of the character generator is set to this temperature, such that no or only a small regulation of the luminous power occurs within the character generator.

The regulation routes of the printing device shown in FIG. 2 are as follows. On the photoconductor drum 4, a charging zone 31 is generated that can be measured with the potential sensor 28. In addition to this, the photoconductor drum 4 is exposed in the region 30 of the discharge mark with the light originating from the character generator 6, whereby the potential on the photoconductor drum 4 decreases. The potentials in the images 30 and 31 are measured with potential sensor 28, and thus the discharge depth of the electrophotographic system is measured. A correction value is determined from the discharge depth, that, on the one hand, enters into a luminous duration regulation 25*b* of the character generator luminous power control 25, and on the other hand influences the current flowing through the LED via the current control 25*a*. The temperature of the photoconductor drum 4 measured by the temperature sensor 27 can influence both effects as an additional parameter.

Figure 3:
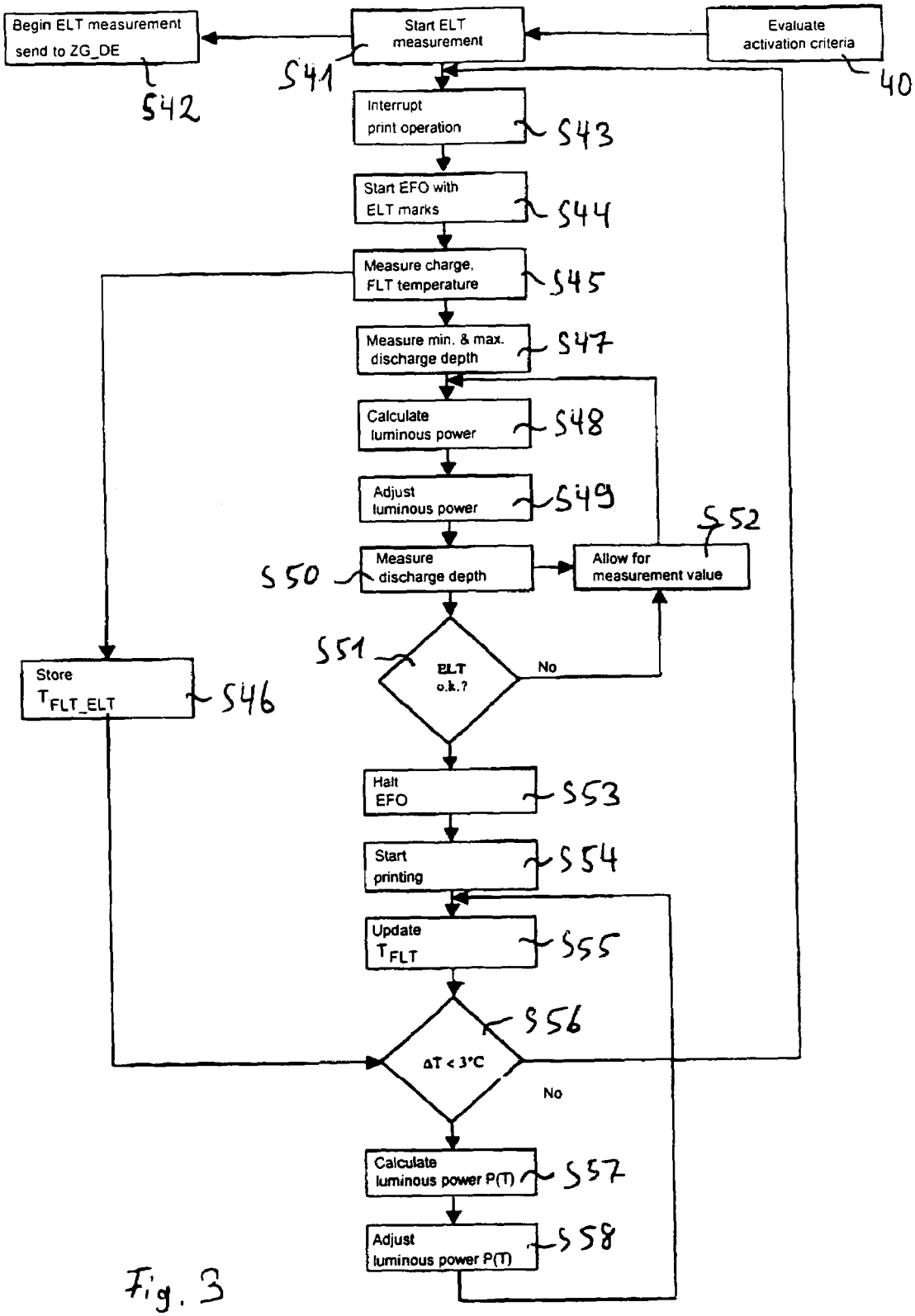
FIG. 3 illustrates a flow chart of a regulation method for the electrophotographic components.
Figure 4:
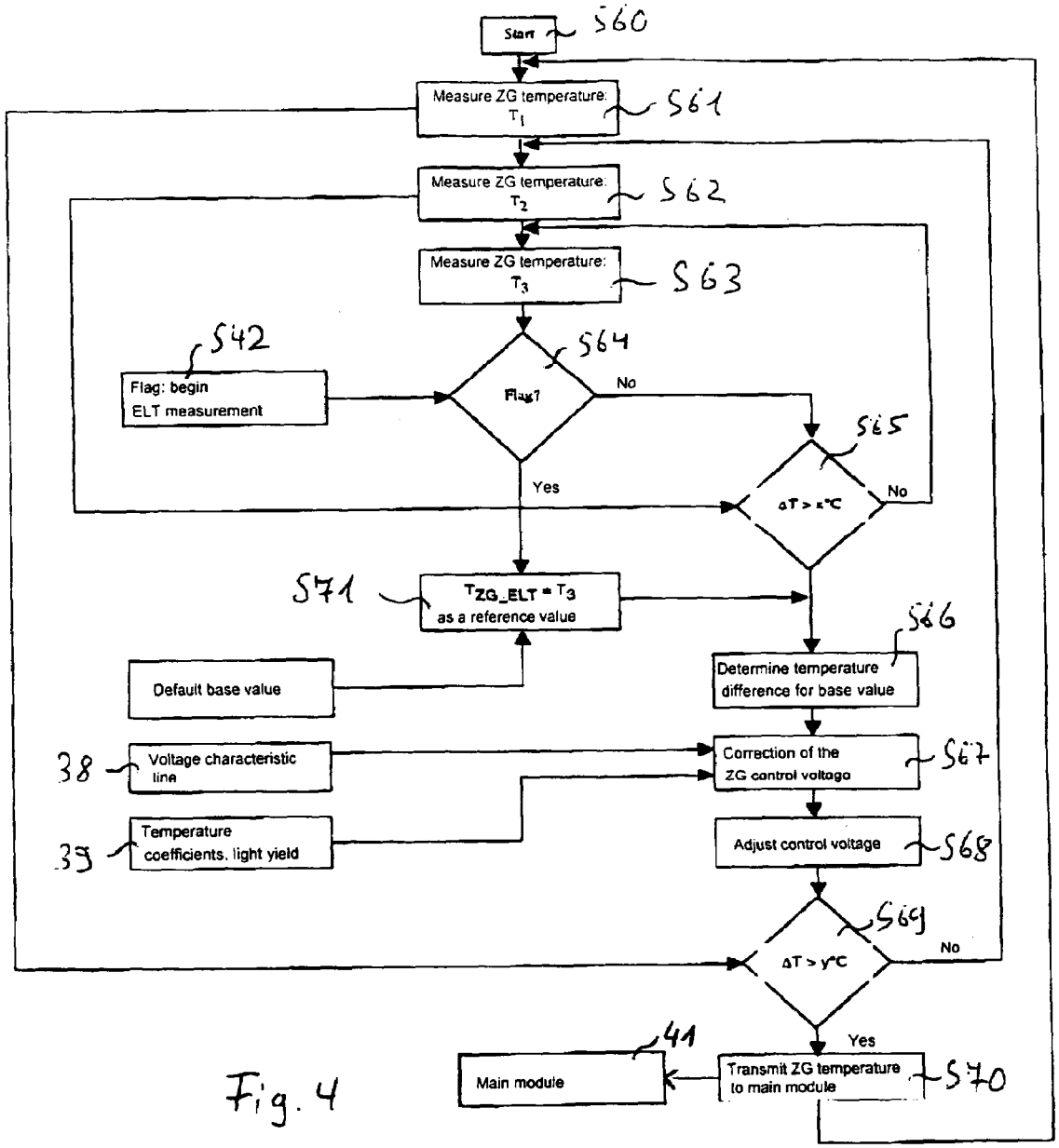
FIG. 4 is a flow chart of a regulation method for the character generator components.

The course of a regulation cycle with discharge depth measurement is shown in FIG. 3. Activation criteria 40 such as, for example, too little inking on toner measurement markings effect the start of a discharge depth measurement S41. This start is also reported in step S42 to the activation electronics of the character generator 25. In step S43, the print operation is interrupted, and in step S44 the electrophotographic components with discharge depth markings are started. In step S45, the charging of the photoconductor drum and the temperature of the photoconductor drum are measured. The measured temperature value $T_{FLTELT}$ is stored in step S46. The minimum and the maximum discharge depth are measured in step S47. The luminous power, which is necessary for an optimal discharge depth, is calculated from these measurement values in step S48. The corresponding luminous power is adjusted on the character generator in step S49 and the discharge depth is newly measured in step S50. The measurement value is buffered and, after testing in step S51 as to whether the discharge depth is in order, if necessary the measurement value is considered in step S52 in order to newly calculate the luminous power (step S48). In the case that the discharge depth is found to be in order in step S51, in step S53 the electrophotography is stopped and in step S54 the printer is restarted. The temperature of the photoconductor drum is newly measured in step S55, and it is checked in step S56 as to whether the current measured temperature varies by a specific amount, for example by 3 degrees Celsius, from the temperature previously stored in step S46. If the variation is greater, the print operation is newly interrupted (step S43), and the measurement of the discharge depth is newly implemented. If the temperature variation in step S56 is smaller than the predetermined amount of 3 degrees Celsius, then the luminous power is calculated in step S57 dependent on the temperature, and newly adjusted in step S58. Then step S55 is returned to and the temperature difference is newly calculated in step S56.

Via the notice occurring in step S42 of the character generator control assembly group 25, this uses the current measured character generator temperature as a new temperature basis for its regulation, whereby the valid correction value is eliminated. A compensation of the temperature effects in the character generator and the photoconductor via the net effect of their opposite effects thereby occurs in the subsequent calibration routine of the discharge depth.

The character generator-side cycle is shown in FIG. 6 that results in connection with the above-specified cycle of the electrophotographic components. To start the character generator regulation in step S60, a first character generator temperature $T_1$ is measured and stored in step S61. A second character generator temperature $T_2$ is measured and stored in step S62, and a third character generator temperature $T_3$ is measured and stored in step S63. It is tested in step S64 whether the flag coming from the electrophotography measurement in step S42 is set, after which a discharge depth regulation is started. In the case that this flag is not set, it is checked in step S65 whether the temperature difference between the temperatures $T_2$ and $T_3$ exhibit a predetermined value x of, for example, 5 degrees Celsius. When this is the case, a temperature difference is determined in step S66 as a base value, and a correction value for the character generator control voltage is calculated in step S67. The voltage characteristic line 38 and the temperature coefficient thereby enter into the calculation for the light yield 39. The control voltage is adjusted in the character generator in step S68. It is then tested in step S69 whether the temperature difference between $T_3$ and $T_1$ is larger than a value Y of, for example, 10 degrees Celsius. In the case that this is not the case, step S62 (measurement of the character generator temperature $T_2$) is returned to. If the temperature difference is greater than y, the current character generator temperature $T_3$ is sent to the main module in step S70 and step S61 (measurement of character generator temperature $T_1$) is returned to. The course control runs on the main module 41 according to FIG. 3.

If, in the testing whether the temperature difference T2 and T3 are larger than x, the result is no, then step S63 (measuring the character generator temperature $T_3$) is returned to. If it is established in step S64 that the flag is set over the starting measurement of the discharge depth, then in step S71 the temperature $T_{ZG_ELT}$ is set equal to $T_3$ as a base value.

The regulation specified here operates with two modes: the actual regulation already runs in the measurement cycle of the discharge depth measurement during the print interruption, in that the measured discharge depth over the variation of desired value as correction leads to a newly adjusted luminous power; whereas during the printing, between the measurement cycles, a control of the luminous power is effected via a correction of the photoconductor drum luminous duration derived from the photoconductor drum temperature. This calculation occurs purely calculatively on the basis of an assumed dependency of the discharge depth upon the continuous measured photoconductor temperature. The light energy of the LED comb is simultaneously stabilized via an evaluation of the character generator temperature change with regard to a predefined base value according to the characteristic line.

However, the specified combined luminous power regulation is also applicable during the printing event in printers with cyclically written discharge marks. However, the discharge depth measurement must thereby occur often enough that the suppression of the character generator temperature compensation during the measurement does not lead to contrast jumps due to the maximum possible change, in particular not within a page. Furthermore, the period between two discharge depth marks can be held short, such that an intrinsic character generator temperature compensation between the measurement value acquisition is no longer reasonable. This would in particular be the case when the interim possible temperature change in the character generator remains so small that it can be directly compensated in the next measurement as a part of the discharge depth adaptation.

Furthermore, it is possible the write the discharge marks at times during which no print image is present or can be present, for example in the region of a paging, a page region without printing area, etc., then the frequency of the discharge marks or, respectively, discharge measurements is significant for the necessity of an additional light energy stabilization in the existing intervals.

The character generator temperature compensation operates with a base current that, with reference to a reference temperature, is adjusted via a control voltage. This base voltage applies first under the conditions of the compensation and ensures the nominal luminous power of the character generator. According to the changing character generator temperature, it is modified with a correction term that accounts for the temperature coefficients of the light yield and the current-voltage characteristic line and is calculated from the variation of the current temperature from the reference temperature. If a criterion for triggering a discharge depth measurement is reached, the reference temperature is immediately replaced by the current temperature in the temperature compensation. The variation of current and reference temperature is thereby set to zero, and the discharge depth is undertaken with the uncorrected luminous power. The subsequent temperature changes also result in only one more variation with regard to the temperature measured in the last discharge depth measurement.

Should a power increase occur, an additional core is introduced that, with the same coefficients and characteristic line, accounts for the variation of the current reference temperature in a predefined cold start boundary temperature. This additional term corresponds to a superproportional temperature compensation, since in the calculation of the drive current the character generator is assumed to be warmer that it actually is. The difference between the boundary temperature and the minimum formed from boundary temperature and current reference temperature thus becomes continuously smaller with rising character generator temperature of the correction term, in order to disappear after reaching the boundary temperature, but also to again increase in value as soon as this limit is again under-run. If the boundary temperature is selected such that, together with the necessary temperature stabilization, a character generator temperature to be compensated is not over-run by a few degrees until initiation of a discharge depth measurement of the previous framework, no risky regions are also reached in which non-uniform exposures are to be feared. For the control voltage of the actual luminous power of the LEDs, the following is valid:

$$V_{I\,LED}=V_{base}+V_{corr}(T_{REF}-T_{current})+V_{corr}(T_{limit}-MIN(T_{limit},T_{current}))$$

occurs, whereby $V_{I\,LED}$=control voltage $V_{base}$=base voltage $V_{corr}$=temperature coefficient for the luminous power stabilization $T_{REF}$=current reference temperature $T_{current}$=current measured temperature $T_{limit}$=boundary temperature in which the dynamic superproportional luminous power increase ends.

For example, via a boundary temperature of 28 degrees Celsius, an initial power increase of approximately 10 percent can be achieved that, given a cold printer and extremely insensitive photoconductor drum, leads to a reduction of the time until achievement of the required discharge depth via continuous printing, in a printing device of the applicant, of approximately 20,000 pages. The formula cited above can naturally also be specified in a multiplicative notation.

Although the control device and method was specified as an example of an electrophotographic printer with an LED character generator, it can also be used in other electrophotographic devices, such as for example magnetographic or ionographic devices, as well as in devices with other light sources such as, for example, laser character generators.

The control device and method can be designed as an electronic control, as a device, or as a computer program product, whereby it occurs as the latter in particular in cooperation with a computer or an electronic control. As such, it can in particular appear on data media such as, for example, diskettes, CD- or DVD-ROMs, or other comparable media, or be distributed as a computer-readable file via a computer network.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

I claim as my invention:

1. A control device to optimize load image generation in an electrophotographic process, comprising:

a light-sensitive and temperature-sensitive photoconductor layer for pixel-by-pixel exposure with a temperature-sensitive light source;

the photoconductor layer being more sensitive with rising temperature, such that given a predetermined quantity of light and predetermined charge it discharges deeper;

the light source emitting a lesser luminous power with rising temperature given a same actuation power;

a respective temperature compensation for the light source and for the photoconductor layer;

the temperature compensation for the photoconductor layer being at least one of adapting current flowing through the light source and adapting exposure time of the light source;

the temperature compensation for the light source being at least one of correction of the current flowing through the light source and a change of the exposure time;

for the temperature compensation of the photoconductor layer a measurement event which measures a discharge depth of the photoconductor layer given predetermined luminous duration and predetermined current throuah the light source;

a temperature of the light source measured in the course of the measurement event being used as a reference value for the temperature compensation of the light source; and light energy of the light source being held constant between successive discharge depth measurements.

2. The control device according to claim 1 wherein the temperature-dependent regulation of the light source occurs via the current flowing through the light source, whereby in a calculating unit, as a function of a variation of the reference temperature, a correction term is introduced that effects a predetermined light energy change, the correction term being discontinued when the measurement of the discharge depth occurs.

3. A control device to optimize load image generation in an electrophotographic process, comprising:

a light-sensitive and temperature-sensitive photoconductor layer for pixel-by-pixel exposure with a temperature-sensitive light source;

the photoconductor layer being more sensitive with rising temperature, such that given a predetermined guantity of light and predetermined charge it discharges deeper;

the light source emitting a lesser luminous power with rising temperature given a same actuation power;

a respective temperature compensation for the light source and for the photoconductor layer;

the temperature compensation for the photoconductor layer being at least one of adapting current flowing through the light source and adapting exposure time of the light source;

the temperature compensation for the light source being at least one of correction of the current flowing through the light source and a chance of the exposure time;

for the temperature compensation of the photoconductor layer a measurement event which measures a discharge death of the photoconductor layer given predetermined luminous duration and predetermined current through the light source;

a temperature of the light source measured in the course of the measurement event being used as a reference value for the temperature compensation of the light source; and in an operating phase of lesser temperature than a nominal temperature $T_{limit}$, a temperature overcompensation occurs for the light source such that the activation power is dynamically superproportionally raised.

4. The control device according to claim 3 wherein a trigger voltage for the luminous power occurs according to a formula $$V_{I\,LED}=V_{base}+V_{corr}(T_{REF}-T_{current})+V_{corr}(T_{limit}-MIN(T_{limit},T_{current}))$$

where $V_{I\,LED}$=control voltage $V_{base}$=base voltage $V_{corr}$=temperature coefficient for the luminous power stabilization $T_{REF}$=current reference temperature $T_{current}$=current measured temperature $T_{limit}$=boundary temperature in which the dynamic superproportional luminous power increase ends.

5. A method for optimizing load image generation in an electrophotographic process, comprising the steps of:

providing a light-sensitive and temperature-sensitive photoconductor layer for exposure pixel-by-pixel with a temperature-sensitive light source;

the photoconductor layer becoming more sensitive with rising temperature such that given a predetermined guantity of light and predetermined charge it discharges deeper;

the light source emitting a lesser luminous power with rising temperature given a same actuation power;

providing a respective temperature compensation for the light source and for the photoconductor layer;

providing the temperature compensation for the photoconductor layer by at least one of adapting current flowing through the light source and adapting exposure time of the light source;

providing the temperature compensation for the light source by at least one of correction of current flowing through the light source and change of exposure time;

for the temperature compensation of the photoconductor layer, providing a measurement event in which a discharge death of the ohotoconductor layer is predetermined given predetermined luminous duration and predetermined current through the light source;

using a temperature of the light source measured in the course of the measurement event as a reference value for the temperature compensation of the light source; and in an operating phase of lesser temperature than a nominal temperature $T_{limit}$, a temperature over-compensation occurring for the light source such that the activation power is dynamically increased until the nominal temperature is reached.

6. A method for optimizing load image generation in an electrophotographic process, comprising the steps of:

providing a light-sensitive and temperature-sensitive photoconductor layer for exposure pixel-by-pixel with a temperature-sensitive light source:

the photoconductor layer becoming more sensitive with rising temperature such that given a predetermined guantity of light and predetermined charge it discharges deeper;

the light source emitting a lesser luminous power with rising temperature given a same actuation power;

providing a respective temperature compensation for the light source and for the photoconductor layer;

providing the temperature compensation for the photoconductor layer by at least one of adapting current flowing through the light source and adapting exposure time of the light source;

providing the temperature compensation for the light source by at least one of correction of current flowing through the light source and change of exposure time;

for the temperature compensation of the photoconductor layer, providing a measurement event in which a discharge depth of the photoconductor layer is predetermined given predetermined luminous duration and predetermined current through the light source;

using a temperature of the light source measured in the course of the measurement event as a reference value for the temperature compensation of the light source; and in an operating phase of lesser temperature than a nominal temperature $T_{limit}$, a temperature over-compensation occurs for the light source such that the activation power is dynamically increased superproportionally.

7. A computer program product for optimizing load image generation in an electrophotographic process wherein a light-sensitive and temperature-sensitive photoconductor layer are provided for exposure pixel-by-pixel with a temperature-sensitive light source, the photoconductor layer being more sensitive with rising temperature such that given a predetermined quantity of light and predetermined charge it discharges deeper, and the light source emitting a lesser luminous power with rising temperature given a same actuation power, said computer program product comprising:

a program on a computer readable media; and said program providing temperature compensation for the photoconductor layer by controlling at least one of an adaption of current flowing through the light source and an adaption of exposure time of the light source, providing temperature compensation for the light source by at least one of correcting current flowing through the light source and changing exposure time, for said temperature compensation of the photoconductor layer controlling provision of a measuring event in which a discharge depth of the photoconductor layer is predetermined given predetermined luminous duration and predetermining current through the light source, using a temperature of the light source measured in the course of the measurement event as a reference value for the temperature compensation of the light source, and holding light energy of the light source constant between successive discharge depth measurements.

8. A computer program product for optimizing load image generation in an electrophotographic process wherein a light-sensitive and temperature-sensitive photoconductor layer are provided for exposure pixel-by-pixel with a temperature-sensitive light source, the photoconductor layer being more sensitive with rising temperature such that given a predetermined quantity of light and predetermined charge it discharges deeper, and the light source emitting a lesser luminous power with rising temperature given a same actuation power, said computer program product comprising:

a program on a computer readable media; and said program providing temperature compensation for the photoconductor layer by controlling at least one of an adaption of current flowing through the light source and an adaption of exposure time of the light source, providing temperature compensation for the light source by at least one of correcting current flowing through the light source and changing exposure time, for said temperature compensation of the photoconductor layer controlling provision of a measuring event in which a discharge depth of the photoconductor layer is predetermined given predetermined luminous duration and predetermining current through the light source, said computer program using a temperature of the light source measured in the course of the measurement event as a reference value for the temperature compensation of the light source, and said computer program in an operating phase of lesser temperature than a nominal temperature $T_{limit}$, controlling a temperature over compensation for the light source such that the activation power is dynamically superproportionally raised.

* * * * *